United States Patent [19]

Shemitz

[11] 4,414,609

[45] Nov. 8, 1983

[54] LUMINAIRE FOR A VISUAL DISPLAY TERMINAL

[75] Inventor: Sylvan R. Shemitz, Woodbridge, Conn.

[73] Assignee: Sylvan R. Shemitz and Associates, Inc., West Haven, Conn.

[21] Appl. No.: 433,509

[22] Filed: Oct. 8, 1982

[51] Int. Cl.[3] ..... A61G 13/00

[52] U.S. Cl. ..... 362/33; 362/223; 362/225; 362/236; 362/247; 362/248; 362/249; 362/297

[58] Field of Search ..... 362/33, 223, 225, 236, 362/247, 248, 249, 297

[56] References Cited

U.S. PATENT DOCUMENTS

| | | | |
|---|---|---|---|
| 2,249,610 | 7/1941 | James et al. | 128/396 |
| 2,662,164 | 12/1953 | Murray | 240/4 |
| 3,022,416 | 7/1959 | Roberts | 240/73 |
| 3,101,178 | 8/1963 | Young | 240/51.11 |
| 3,201,582 | 8/1965 | Siegel | 362/243 X |
| 3,389,246 | 6/1968 | Shemitz | 240/2 |
| 3,557,359 | 1/1971 | Meyer | 240/1.4 |
| 3,673,402 | 6/1972 | Weiss | 240/51.11 |
| 4,006,355 | 2/1977 | Shemitz et al. | 240/51.11 |
| 4,054,793 | 10/1977 | Shemitz | 362/127 |
| 4,070,571 | 1/1978 | Robertson et al. | 362/217 |
| 4,161,767 | 7/1979 | Benasutti et al. | 362/33 |
| 4,173,034 | 10/1979 | Shemitz | 362/98 |
| 4,186,433 | 1/1980 | Baldwin | 362/263 |
| 4,203,639 | 5/1980 | VandenHoek et al. | 339/22 |
| 4,204,274 | 5/1980 | Luderitz | 362/239 |
| 4,233,651 | 11/1980 | Fabbri | 362/33 |
| 4,242,723 | 12/1980 | Fabbri et al. | 362/33 |
| 4,254,449 | 3/1981 | Benasutti et al. | 362/33 |
| 4,300,185 | 11/1981 | Wakamatsu | 362/33 |

OTHER PUBLICATIONS

"Task Ambient Lighting–The Complete Catalog", (Elliptipar Inc. 1980).

*Primary Examiner*—Stephen J. Lechert, Jr.
*Attorney, Agent, or Firm*—Thomas L. Giannetti; Eugene S. Indyk

[57] ABSTRACT

An illumination system for a workstation having a backwall, a substantially horizontally disposed work surface, and a visual display terminal adapted to be viewed by an operator in a direction substantially perpendicular to the backwall is disclosed. The system provides a backlighting component of illumination as well as task lighting and ambient lighting.

16 Claims, 12 Drawing Figures

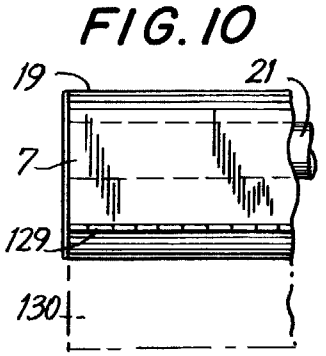
FIG. 10
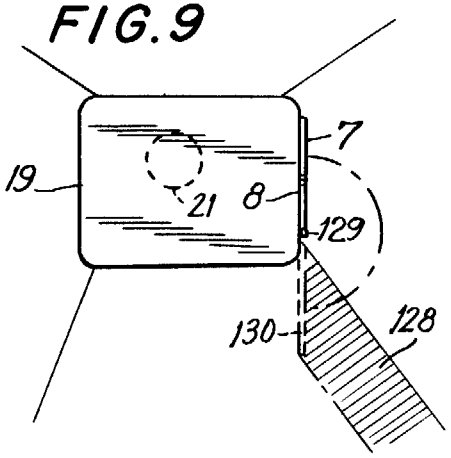
FIG. 9
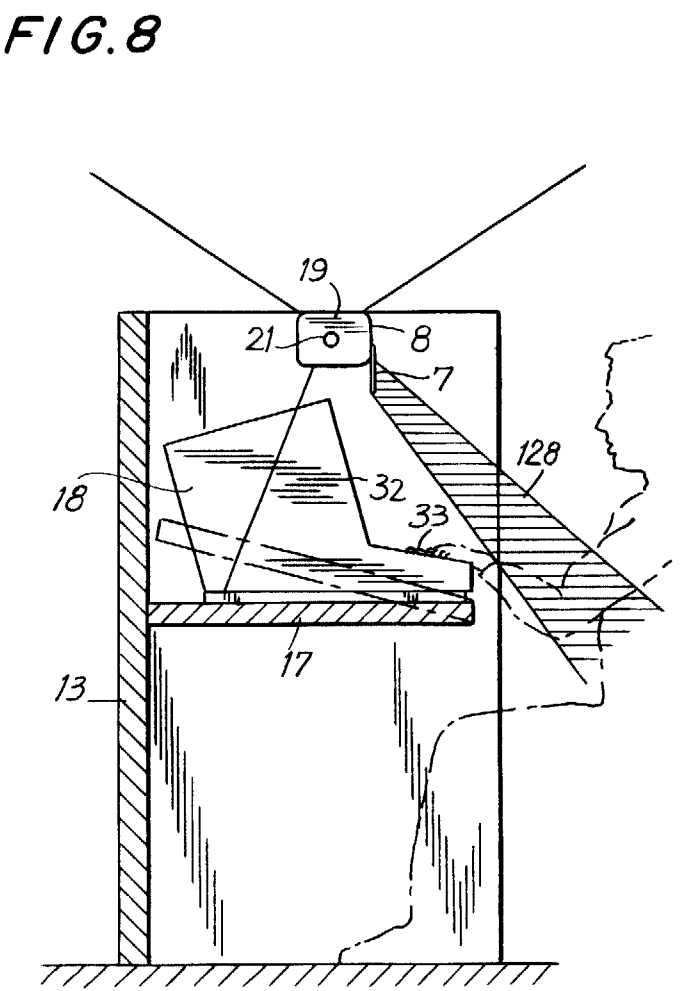
FIG. 8
FIG. 12
FIG. 11

LUMINAIRE FOR A VISUAL DISPLAY TERMINAL

BACKGROUND OF THE INVENTION

This invention relates to the illumination of a visual display terminal and its surroundings. More specifically, the invention concerns the illumination of the keyboard, sides, back, and the area above a visual display terminal.

Prior to this invention, visual display terminals have been illuminated with luminaires fixedly mounted on the ceiling above the terminal or on a wall or partition above and behind the display terminal. Also, there has been developed an illumination system whereby a luminaire mounted above the terminal is horizontally adjustable toward or away from the operator of the terminal to vary the illumination of the keyboard and face of the display terminal.

This prior art scheme has not been completely successful in a number of respects. For example, it has been found deficient in that, as the luminaire is moved forward toward the operator, the wall or backpanel behind the terminal darkens and an objectionable brightness contrast develops between the areas illuminated by the luminaire and the wall or backpanel. An objectionable contrast between the screen of the visual display terminal and the aforementioned wall or backpanel also develops. Another problem discovered is that the prior art luminaires tended to illuminate the person of the operator as the luminaire was moved toward the operator. The operator would see a reflection of his person in the screen of the visual display terminal which would veil the letters or numbers displayed thereon and thereby result in poor contrast and visibility. This problem is particularly troublesome when the operator wears light-colored clothing.

This invention overcomes the problem of brightness contrasts by providing a means for developing a separate backlighting component of illumination. More specifically, a visual display terminal luminaire is provided which directs a portion of the light output of the luminaire to the wall or backpanel behind the display terminal.

In one embodiment of this invention, a reflector is mounted in a luminaire which contains two light sources, preferably cylindrical lighting tubes, one of the light sources providing both illumination of the front, sides, and areas above the terminal, and the other of said sources providing both uplighting and backlighting. These light sources are fixed with respect to each other and are horizontally adjustable toward and away from the operator. The sources are mounted above the terminal, and their longitudinal axes are perpendicular to the direction in which the operator views the terminal.

In another embodiment of the invention, a shaped backlight reflector can preferably be provided in the above-described arrangement to selectively illuminate a portion of the wall or backpanel to reduce excessive brightness perceived by a person standing behind or to the sides of the visual display terminal. A further embodiment of the invention involves fixing of the above-mentioned light source which provides uplighting and backlighting adjacent to the backpanel and allowing only the light source which provides illumination of the front and sides of the terminal to be adjustable horizontally.

The invention overcomes the problem of veiling reflections on the screen of the visual display terminal by the provision of a vertically adjustable shield which is attached to the front fascia of the luminaire. In one embodiment the shield is slidably mounted on the fascia and in another embodiment it is hingedly mounted on said fascia.

SUMMARY OF THE INVENTION

It is an object of this invention to provide an apparatus for illuminating a visual display terminal.

It is a further object of this invention to provide an apparatus for illuminating a visual display terminal which reduces brightness contrasts between the viewing areas of the terminal and the wall or backpanel behind the terminal.

It is still a further object of the invention to provide an apparatus for illuminating a visual display terminal which reduces brightness contrasts between the display screen and the wall or backpanel behind the terminal.

Another object of the invention is to provide an apparatus for illuminating a visual display terminal which reduces reflections of the operator's person, which reflections veil the display of information on the screen of the visual display terminal.

A further object of the invention is to provide a lighting apparatus for a visual display terminal which efficiently and effectively illuminates the terminal and surrounding environment reducing operator eye strain and fatigue.

In accordance with the above objects, the invention is an illumination system for a workstation having a backwall, a substantially horizontally disposed work surface, and a visual display terminal adapted to be viewed by an operator in a direction substantially perpendicular to said backwall. The illumination system comprises a first light source having a first longitudinal axis. This light source is mounted above the visual display terminal with its longitudinal axis substantially parallel to the work surface for directing light onto the backwall. The illumination system further comprises a second light source having a second longitudinal axis, this second light source being mounted at substantially the same height above the visual display terminal as the first light source with its longitudinal axis disposed substantially parallel to the first longitudinal axis. The illumination system further comprises a reflector means associated with the second light source for directing upwardly a portion of light emanating therefrom to provide ambient room lighting and for directing downwardly another portion of that light toward the work surface.

In one alternative embodiment, the illumination system further comprises reflector means associated with the first light source for directing downwardly a portion of the light emanating from said first light source onto the backwall. In another alternative embodiment, this reflector means also directs upwardly a portion of the light emanating from the first light source to provide ambient lighting. In another embodiment, the second light source is horizontally adjustable toward or away from the operator of the visual display terminal. In still another alternative embodiment, the first light source is fixedly attached to the second light source for horizontal adjustment of the first light source with the second light source. In another embodiment, the first light source is held fixed adjacent to the backwall. In another embodiment, the reflector means that can be associated with the first light source is shaped to minimize excessive brightness perceived by persons behind and to the sides of the workstation. In another embodiment, a shield is associated with the second light source for preventing illumination of the operator's person by the second light source. Preferably, the shield is vertically adjustable, and can be slidably or hingedly mounted on the second light source. The shield can be used in luminaires for visual display terminal workstations that do not embody the backlighting features of the previously described embodiments.

BRIEF DESCRIPTION OF THE DRAWINGS

FIG. 8 is a detailed schematic view showing the operation of the vertically adjustable anti-veiling reflection shield of FIG. 2.

FIGS. 9 and 10 depict an embodiment of the anti-veiling reflection sheild which is hingedly mounted on the luminaire of FIG. 2.

FIGS. 11 and 12 depict an embodiment of the anti-veiling reflection shield which is slidably mounted on the luminaire of FIG. 2.

DETAILED DESCRIPTION OF THE INVENTION

Figure 1:
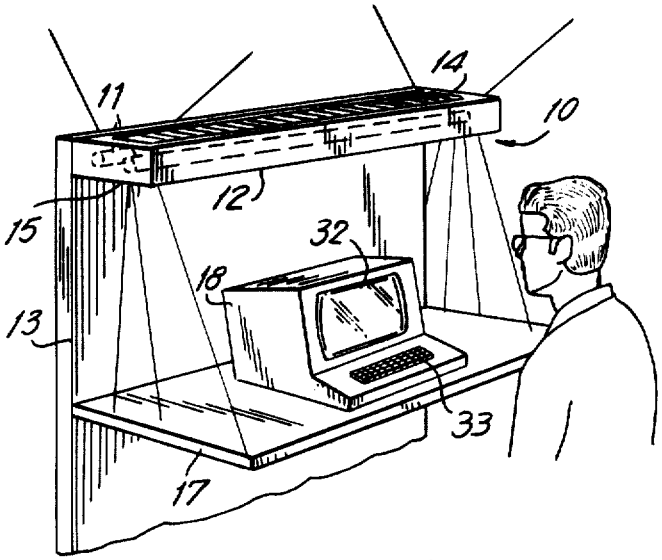
FIG. 1 PRIOR ART
FIG. 1 shows a prior art illumination system for a visual display terminal workstation.

FIG. 1 shows a prior art illumination system for visual display terminal workstations. A luminaire 10 comprising a pair of linear lighting tubes 11 mounted in a rectangular housng 12 is mounted adjacent to the backwall 13 of a workstation. The top portion 14 of the luminaire housing is transparent or translucent to allow light from the lighting tubes to be directed upwardly to provide ambient room lighting. The bottom portion 15 of the luminaire housing allows light from the underside of luminaire to illuminate horizontal work surface 17. Work surface 17 is mounted adjacent to backwall 13 at a comfortable height for the worker or operator. Normally, a visual display terminal 18, which can be any one of a class of well-known visual display terminals, is disposed on work surface 17, as shown. As illustrated, visual display terminal 18 typically has a screen 32 for viewing information displayed on the terminal and a keyboard 33.

Figure 2:
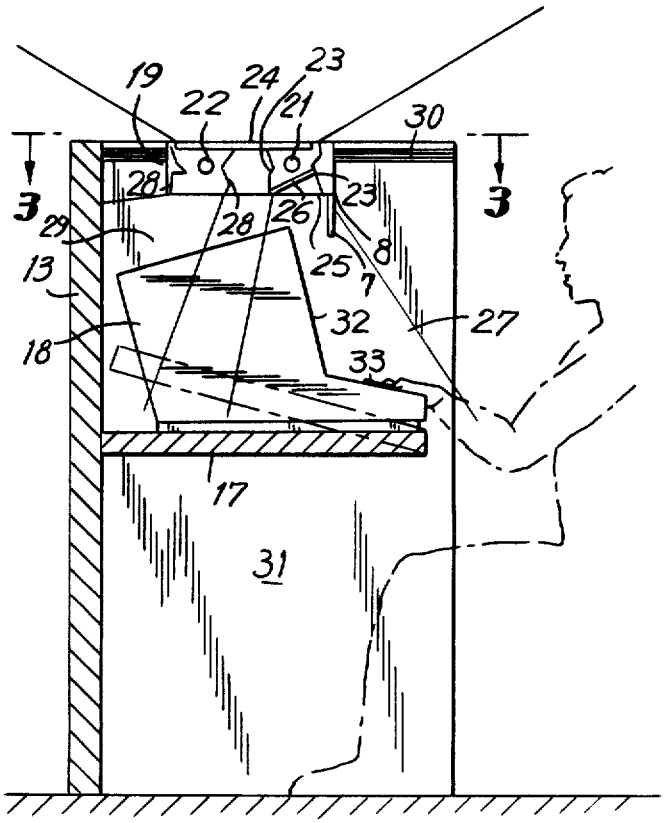
FIG. 2 is a schematic side view, partly in cross-section, of an illumination system for a visual display terminal workstation according to the invention.
Figure 3:
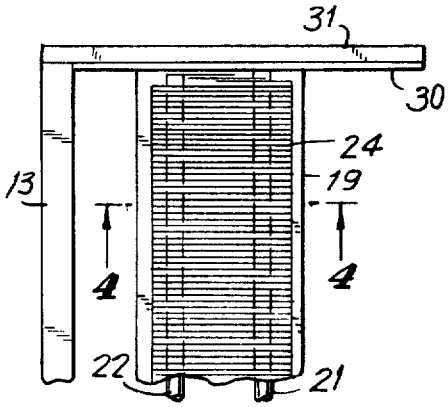
FIG. 3 is a partial top view taken along line 3—3 of FIG. 2.

FIGS. 2 and 3 show an improved visual display terminal illumination system in accordance with applicant's invention wherein like reference numerals have been used to identify elements which correspond to like elements in FIG. 1. FIG. 2 shows a cross-sectional view of the illumination system and FIG. 3 shows a partial top view taken along line 3—3 of FIG. 2, showing the connection between the end of the luminaire housing and the rail member to be hereinafter described.

A rectangular luminaire 19 is mounted above visual display terminal 18 above eye height of a seated operator. The longitudinal axis of luminaire 19 is perpendicular to the line of sight of the operator. Mounted within the housing of the luminaire 19 is a pair of light sources 21 and 22. Each of these sources can be a tube, such as fluorescent or cold cathode, or a point or short line source used singly or in multiples, such as metal halide or high pressure sodium. The longitudinal axes of these light sources are substantially parallel to each other.

Light source 21 is forwardly mounted and is enclosed within the space defined by reflectors 23, transparent, translucent, louvered or baffled top plate 24, and opening 25. Top plate 24 is entirely optional and can be omitted, if desired. As shown in FIG. 2, tilted lens 26 may be mounted in opening 25. However, the opening 25 can be used with or without the lens or other light control devices. Reflectors 23 and lens 26 are configured such that downward illumination is directed to the work surface of the visual display terminal, as shown by reference numeral 27. Lens 26 can be chosen to provide a "batwing" illumination pattern. A suitable structure for such a lens is more fully disclosed in applicant's U.S. Pat. No. 4,054,793, the disclosure of which is hereby incorporated by reference.

Light source 22 is mounted behind light source 21 and is enclosed within the space defined by reflectors 28 and top plate 24, as shown. Reflectors 28 are configured so that downward illumination of light source 22 is directed toward backwall 13, as shown at 29. This backlighting is provided to minimize brightness contrasts between the backwall 13 and the portions of the visual display terminal illuminated by downward light 27 of light source 21. Backlighting also minimizes any brightness contrasts between backwall 13 and the visual display terminal screen 32.

Backwall 13 can be rigid or flexible (for example, a curtain or backdrop) and the invention in any of its embodiments is equally applicable to either form of backwall to reduce brightness contrasts.

It should be pointed out that although FIG. 2 depicts the presence of reflectors 28, they are optional and not necessary for the invention. These reflectors are, however, desirable to selectively direct the light emanating from light source 22 so that the work station can be efficiently and effectively illuminated.

Luminaire 19 is horizontally adjustable toward and away from the terminal operator to adjust the illumination of the work surfaces of the terminal. For example, a conventional roller mechanism can be mounted at each end of the luminaire housing. This roller mechanism engages rail member 30 mounted along sidewall 31 of the workstation.

It is to be understood that the invention is not limited to workstations which have sidewall partitions. In the case where no sidewall partition is provided, rail member 30 can be supported by means such as a floor stand or cantilevered members from backwall 13 at a height suitable for luminaire 19.

It can be seen that such horizontal adjustability enables the operator to direct a suitable amount of light from the luminaire to the screen 32 and keyboard 33 of visual display terminal 18 as well as to the portions of work surface 17 to the sides of the terminal 18. Illumination of backwall 13 of the workstation serves to minimize any undesirable brightness contrasts between the backwall 13 and the screen 32 or keyboard 33 of the terminal 18 which develop when the luminaire 19 is moved toward its front position.

A vertically adjustable anti-veiling reflection shield 7 can be appended to the front fascia 8 of the luminaire. This shield intercepts direct illumination of the operator's person by light source 21, thereby reducing veiling reflections visible on the screen 32 of the visual display terminal 18 and thus increasing the contrast of the information displayed thereon. The operation of the shield 7 will be more fully described in connection with FIGS. 8–12.

Figure 4:
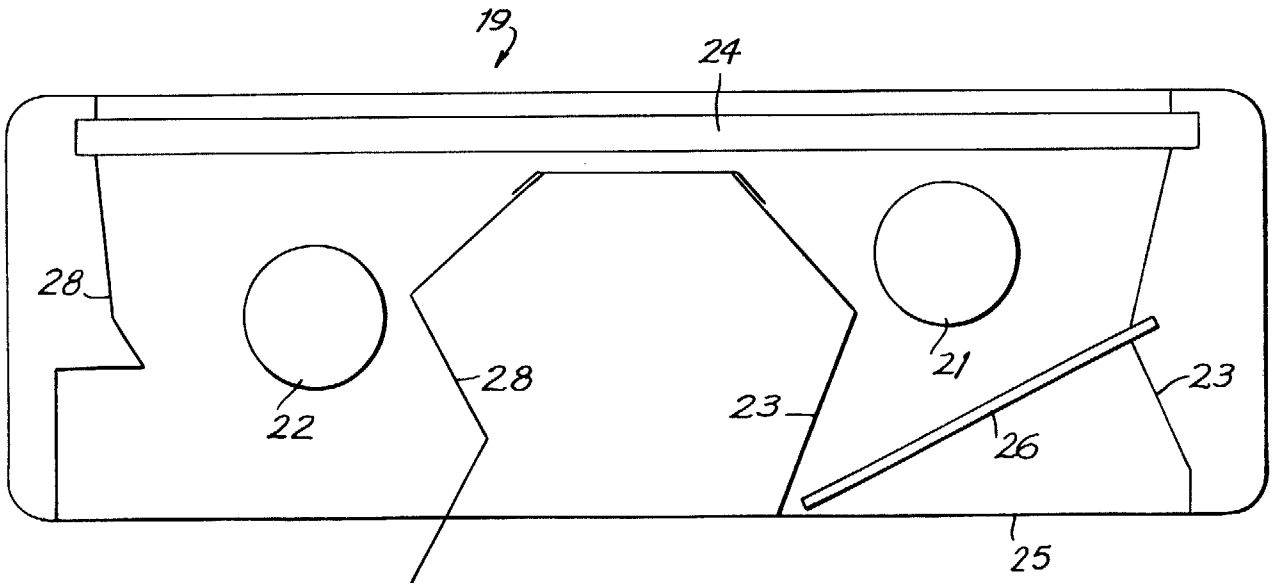
FIG. 4 is an enlarged cross-sectional view of the luminaire shown in FIG. 2.

FIG. 4 shows an enlarged cross-sectional view of the structure of the luminaire 19. Light source 22 is connected to a pair of mounting bracket and socket assemblies (not shown) attached to each end of the luminaire housing. Any conventional assembly of this type is suitable for this purpose. Light source 21 is substantially parallel to light source 22 and is connected to another pair of conventional mounting bracket and socket assemblies (not shown) mounted at each end of the luminaire housing.

As can be seen in FIG. 4, lens 26 may be mounted in opening 25 below light source 21 at an angle with respect to the horizontal. This angle is chosen so that suitable downward illumination of the work surface is achieved. Further details of the structure of lens 26 and its mounting are provided in the above-mentioned U.S. Pat. No. 4,054,793.

Figure 5:
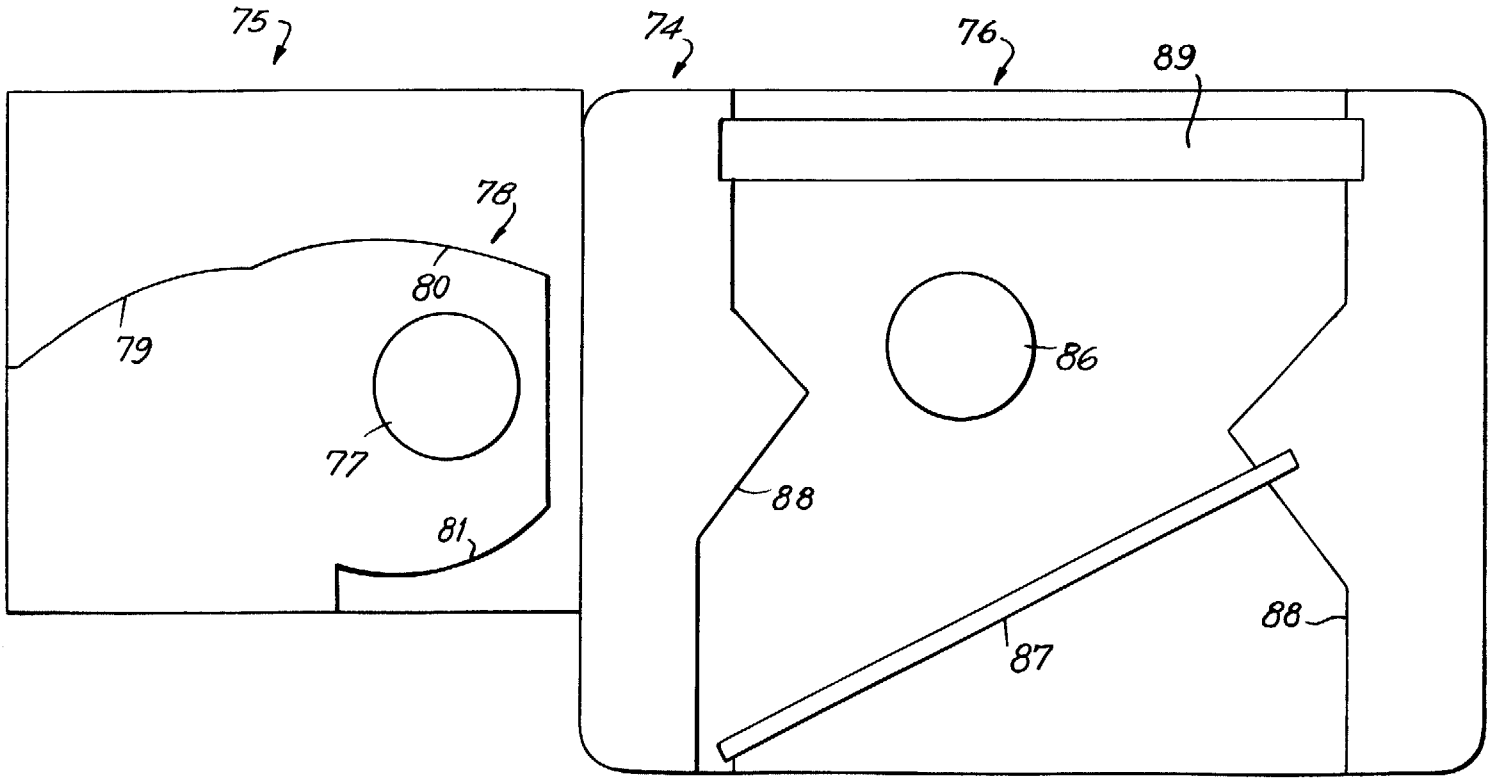
FIG. 5 shows a cross-section an alternate form of luminaire which reduces stray backlighting brightness usable in the arrangement of FIG. 2.

Referring now to FIG. 5, there is shown another embodiment of the present invention. This form of the invention embodies a luminaire which serves to reduce excessive brightness perceived by persons passing the workstation from the rear or the side. As can be seen in FIG. 5, the luminaire 74 is comprised of two elongated housings 75 and 76 attached along a line parallel to their longitudinal axes. Housing 75 contains a light source 77 comparable to light source 22 (FIGS. 2–4). It is secured at each end to the sides of housing 75 by any suitable bracket and socket assembly, such as the one previously described in connection with FIG. 4. Preferably, a reflector 78 is provided controlling the light emanating from the light source 77. As shown in FIG. 5, the reflector comprises curved sections 79-81. However, other reflector configurations or a baffle could be used. Reflector 78 is configured such that the illumination from light source 77 is restricted substantially to the backwall 13. This reduces excessive brightness perceived by anyone passing the workstation substantially due to an uplighting component of illumination from light source 77.

Housing 76 contains a light source 86 similar in all respects to light source 21 previously described. It also contains lens 87, reflectors 88 and top plate 89 similar, respectively, to lens 26, reflectors 23 and top plate 24 previously described in connection with FIGS. 2 and 4. Likewise, the mounting of lens 87 and reflectors 88 in housing 76 is similar, respectively to the mounting of lens 26 and reflectors 23 in the structure of FIGS. 2 and 4.

It will be understood that the embodiment of the invention illustrated in FIG. 5 would be mounted with respect to the visual display terminal and operator generally as shown and described with respect to luminaire 19 shown in FIGS. 2–3.

Figure 6:
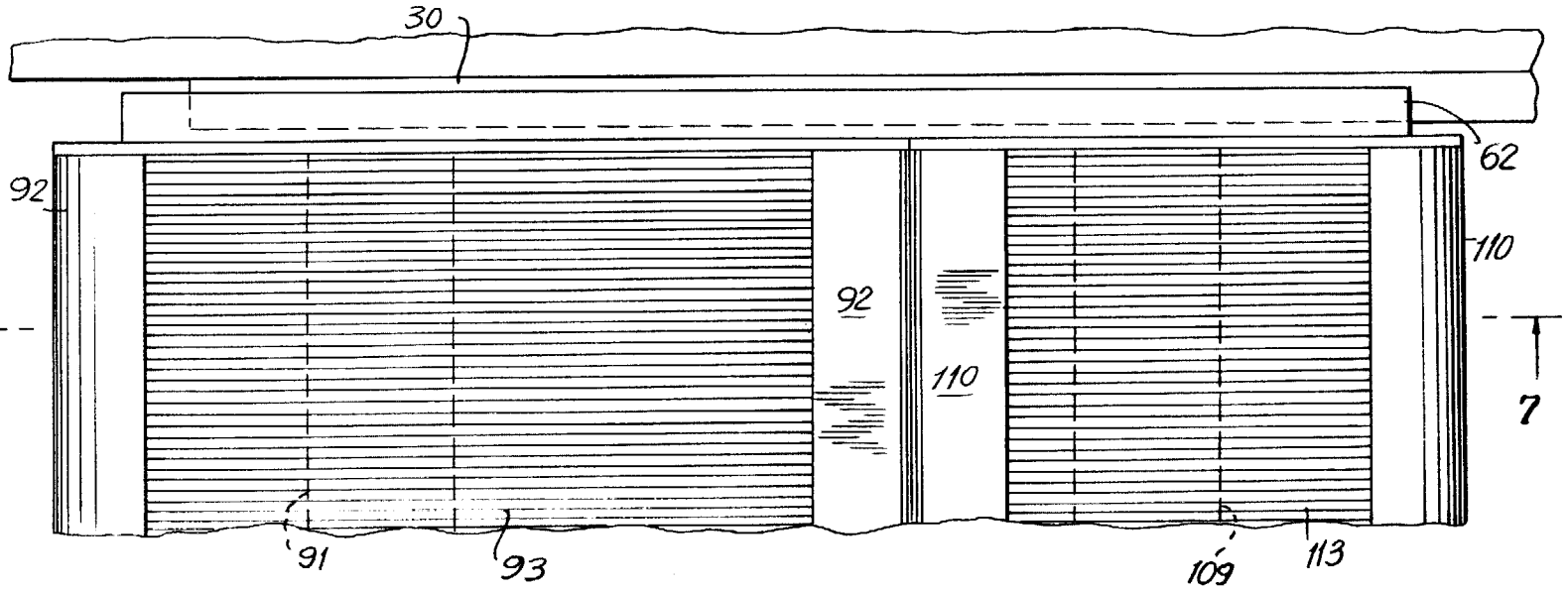
FIG. 6 is a top view of another form of luminaire which provides fixed backlighting and horizontally adjustable work surface lighting.
Figure 7:
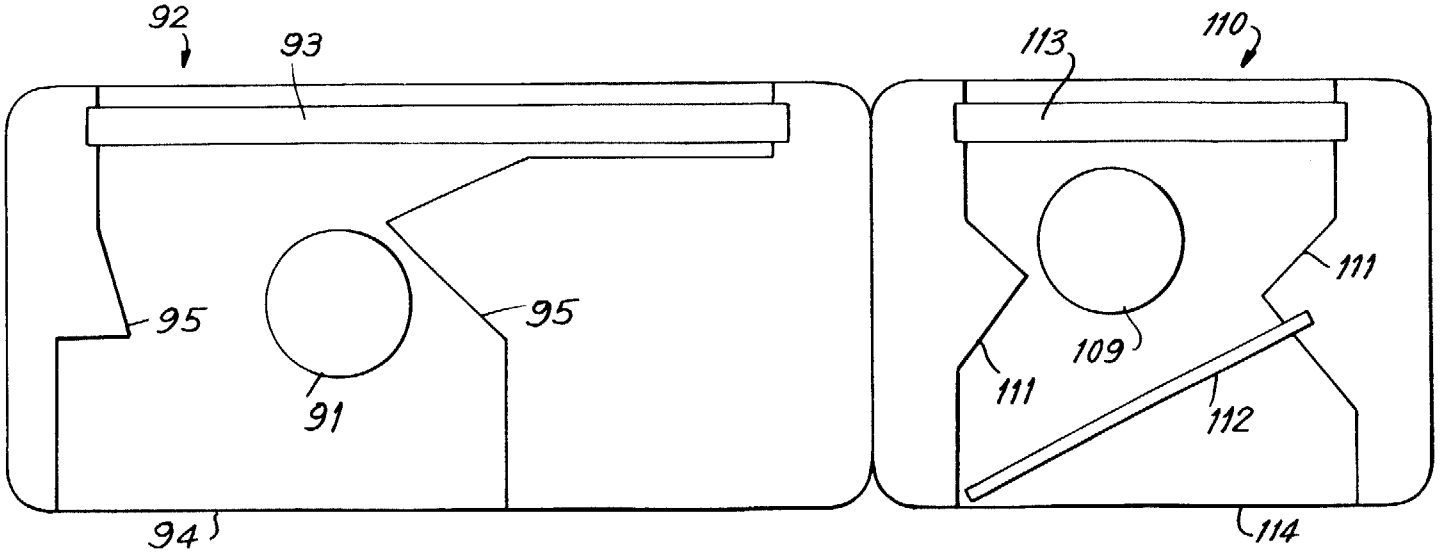
FIG. 7 is a cross-sectional view taken along line 7—7 of FIG. 6.

FIGS. 6 and 7 show another embodiment of the invention. This embodiment differs from the embodiment shown in FIG. 4 in that only the light source which provides illumination of the work surface is horizontally adjustable. The light source which illuminates the backwall is fixedly mounted adjacent to said backwall.

In FIGS. 6 and 7, a backlighting source 91 is enclosed by housing 92, and is mounted within the space defined by top plate 93, opening 94 and reflectors 95. Top plate 93 can be transparent, translucent, louvered, or baffled. Top plate 93 is entirely optional and can be omitted, if desired. The rear portion of housing 92 is fixed adjacent to a backwall, such as backwall 13 shown in FIG. 2. Illumination of backwall 13 is provided by light source 91 through opening 94. Upward ambient lighting is provided by light source 91 through top plate 93.

Although preferable for the same reasons as reflectors 28 in the embodiment of FIGS. 2–4, reflectors 95 are entirely optional.

Still referring to FIGS. 6 and 7, work surface lighting tube 109 is enclosed by housing 110, and is mounted in the space defined by reflectors 111, top plate 113 and opening 114. As can be seen in FIG. 7, lens 112 can be mounted in opening 114 in a fashion similar to that of lens 26 of FIGS. 2 and 4. Top plate 113 is in all respects similar to top plate 24 of FIGS. 2 and 4.

The ends of housing 110 are provided with roller mechanisms 62 similar to those previously described in connection with FIGS. 2 and 4 which enable housing 110 to be horizontally adjustable in a direction toward or away from the operator of the workstation. From the foregoing, it can be seen that this embodiment provides horizontal adjustability of the portion of the luminaire which provides illumination of the work area while the other portion of the luminaire which provides illumination of the backwall of the workstation remains fixed. This format provides for improved reduction of brightness contrasts otherwise produced by movement of the luminaire toward the front of the workstation because, in the arrangement shown in FIGS. 6 and 7, the amount of illumination of the backwall does not appreciably decrease with forward movement of the luminaire.

Now referring to FIGS. 8 through 12, there is shown the operation of shield device 7 which reduces reflections of the person of the operator of the visual display terminal. Contrast between the figures and the background displayed on the faceplate of the visual display terminal is thereby increased. Only details descriptive of and pertinent to the operation of shield 7 have been depicted in FIGS. 8 through 12, the other details of the invention having been previously described and depicted. Elements comparable to those shown in FIG. 2 have been assigned like reference numerals in FIGS. 8 through 12.

Referring to FIG. 8, vertically adjustable shield 7 is shown attached to the front fascia 8 of luminaire 19. As previously disclosed, light source 21 serves to illuminate the work area of the visual display terminal 18. It has been found that if the operator wears light-colored clothing, reflections of such light-colored clothing appear on the faceplate 32 of visual display terminal 18. This tends to reduce the contrast of the information displayed on the screen 32. To overcome this problem, a rectangular, vertically adjustable shield 7 is attached to the front fascia 8 of luminaire 19.

The height of shield 7 is such that the shield intercepts any direct light from light source 21 that would otherwise brighten the clothing of the operator. The width of shield 7 can be such that it extends the full horizontal length of the luminaire 19, but the shield may be made only wide enough to intercept the light from source 21 that would brighten the operator's clothing.

Reference numeral 128 of FIGS. 8, 9, and 11 depict the effect of shield 7 on the illumination pattern produced by luminaire 19.

The shield 7 can be attached to front fascia 8 by a hinge 129 as shown in FIGS. 9 and 10. As is readily apparent, the shield can be vertically adjusted by pivotal motion about hinge 129 so that the operator can select a desirable pattern of illumination. It is shown in the extreme up position in FIGS. 9 and 10. Reference numeral 130 depicts in phantom the shield 7 in the extreme down position.

Alternatively, shield 7 can be mounted for sliding motion in a vertical direction. FIGS. 11 and 12 depict shield 7 which has formed therein a slot 131 which engages pin 132 slidably attaching the shield to front facia 8, thus providing vertical adjustability of shield 7. FIGS. 11 and 12 show shield 7 in the extreme up position, reference numeral 133 depicting in phantom the shield in the extreme down position.

Shield 7 can be used in luminaires for visual display terminal workstations that do not embody backlighting features as well as those that do so.

I claim:

1. An illumination system for a workstation having a backwall, a substantially horizontally disposed work surface, and a visual display terminal adapted to be viewed by an operator in a direction substantially perpendicular to said backwall, comprising:

a first light source having a first longitudinal axis, said first light source being mounted above said visual display terminal with said longitudinal axis substantially parallel to said work surface for directing light onto said backwall;

a second light source having a second longitudinal axis, said second light source being mounted at substantially the same height above the visual display terminal as said first light source with said second longitudinal axis disposed substantially parallel to said first longitudinal axis; and reflector means associated with said second light source for directing upwardly a portion of the light emanating from said second light source to provide ambient room lighting and for directing downwardly another portion of said light toward said work surface.

2. The illumination system of claim 1, further comprising reflector means associated with said first light source for directing a portion of the light emanating therefrom onto said backwall.

3. The illumination system of claim 2, wherein said reflector means associated with said first light source further directs a portion of said light emanating from said first light source upwardly to provide ambient lighting.

4. The illumination system of claim 2, wherein said reflector means associated with said first light source is shaped to minimize excessive brightness behind and to the sides of said workstation.

5. The illumination system of claim 1, wherein said second light source is horizontally adjustable toward or away from the operator of said visual display terminal.

6. The illumination system of claim 5, further comprising:

roller means connected to said second light source for providing horizontal adjustability of said second light source.

7. The illumination system of claim 5, wherein said first light source is fixedly attached to said second light source for horizontal adjustment of said first light source with said second light source.

8. The illumination system of claim 5, wherein said first light source is held fixed adjacent to said backwall.

9. The illumination system of claim 1, further comprising:

a shield associated with said second light source for preventing illumination of the operator's person by said second light source.

10. The illumination system of claim 9, wherein said shield is vertically adjustable.

11. The illumination system of claim 10, wherein said shield is hingedly mounted on said second light source.

12. The illumination system of claim 10, wherein said shield is slideably mounted on said second light source.

13. An illumination system for a workstation having a substantially horizontally disposed work surface, and a visual display terminal adapted to be viewed by an operator in a first direction, comprising:

a light source having a first longitudinal axis, said light source being mounted above said visual display terminal with said longitudinal axis substantially parallel to said work surface;

reflector means associated with said light source for directing upwardly a portion of the light emanating from said light source to provide ambient room lighting and for directing downwardly another portion of said light toward said work surface; and a shield associated with said light source for preventing illumination of the operator's person by said light source.

14. The illumination system of claim 13, wherein said shield is vertically adjustable.

15. The illumination system of claim 14, wherein said shield is hingedly mounted on said light source.

16. The illumination system of claim 14, wherein said shield is slideably mounted on said light source.

* * * * *